United States Patent [19]

Gattrugeri

[11] Patent Number: 4,467,977

[45] Date of Patent: Aug. 28, 1984

[54] EXPANDING HEADPIECE FOR REELS IN GENERAL

[76] Inventor: Giovanni Gattrugeri, Viale Col di Lana 2, Milano, Italy

[21] Appl. No.: 455,620

[22] Filed: Jan. 4, 1983

[30] Foreign Application Priority Data

Jan. 27, 1982 [IT] Italy ..... 19325 A/82

[51] Int. Cl.[3] ..... B65H 75/24

[52] U.S. Cl. ..... 242/72 B; 242/68.2; 279/2 A

[58] Field of Search ..... 242/72 B, 72 R, 68.2, 242/46.2, 46.3, 46.4, 46.6; 279/2 R, 2 A

[56] References Cited

U.S. PATENT DOCUMENTS

| | | | |
|---|---|---|---|
| 2,134,475 | 10/1938 | Green | 242/68.2 |
| 2,621,867 | 12/1952 | Grettve | 242/72 B |
| 2,697,563 | 12/1954 | Miller | 242/68.2 |
| 2,903,200 | 9/1959 | McDougall et al. | 242/68.2 |
| 3,032,288 | 5/1962 | Tidland | 242/72 B |
| 3,097,808 | 7/1963 | Williams | 242/68.2 |
| 3,108,757 | 10/1963 | Williams et al. | 242/68.2 |
| 3,127,124 | 3/1964 | Tidland et al. | 242/72 B |
| 3,298,626 | 1/1967 | Frick et al. | 242/72 B |
| 3,510,082 | 5/1970 | Sexton et al. | 242/68.2 |

*Primary Examiner*—Stanley N. Gilreath

*Attorney, Agent, or Firm*—Guido Modiano; Albert Josif

[57] ABSTRACT

The invention concerns an expanding headpiece for reels in general, which comprises first and second flanges, mutually secured coaxially together in spaced apart relationship, at the area included between said flanges there being provided an annular chamber of an elastically deformable material which can be expanded pneumatically to make said headpiece rigid with the interior of a reel core or the like.

A peculiarity of the invention is that between said first and second flanges, at at least one base of said annular chamber, means are provided for centering said headpiece in said core which can be expanded radially by expanding said annular chamber in an axial direction.

9 Claims, 6 Drawing Figures

EXPANDING HEADPIECE FOR REELS IN GENERAL

BACKGROUND OF THE INVENTION

This invention relates to an expanding headpiece for reels in general.

For many industrial applications where a sheet or web element is to be wound and unwound on/from a reel, it is known to utilize expanding headpieces which are inserted into the reel core to function as rotary motion supports.

Considering the particular field of pneumatic action expanding headpieces, a headpiece is disclosed in U.S. Pat. No. 3,108,757 which comprises a cylindrical body which is secured to its rotary shaft by means of clamps or jaws and has on its external surface an annular receptacle accommodating an annular chamber therein, which annular chamber is formed from an elastically deformable material and can be expanded radially by pneumatic action such as to make the headpiece rigid with the interior of the core of a reel.

That approach, while affording the advantage of automatically accommodating any play which may develop in the course of the rotary operating steps, has the disadvantage of being non-selfcentering, in that the applied weight load of the reel, owing to the rotation axis being horizontal, unavoidably induces a degree of eccentricity in the deformation of the membrane or elastic annular chamber, with consequent eccentric rotation of the reel as a whole, which may result in a number of problems, especially where high winding and unwinding speeds are used, and hence produces vibration of considerable magnitude.

In an effort to remove such a drawback, the outside surface dimensions of the cited headpiece type are selected to be as close as possible to the inside diameter dimensions of the reel core, so as to minimize play; of course, this expedient can only be palliative, because the reel inside diameters differ, however slightly, between reels and it is unthinkable of providing a number of headpieces for each reel to obtain accurately fitting dimensions.

U.S. Pat. No. 3,097,808 discloses an expanding headpiece which can be engaged with the axial ends of the reel core in so-called "shaft-less" systems, wherein to make the headpiece self-centering, said headpiece again comprising a pneumatically deformable elastic material annular chamber as an expansion member, at the side connection flange a frustoconical surface is provided which, when inserted into the core and, acts as a self-centering support or bearing member. However, the contact area between the frustoconical surface and reel end is in this case generally quite small, and the deformations unavoidably undergone by the reel core during the operating steps create plays which result in the reel being liable to take a less than perfectly centered attitude relatively to its rotation axis.

SUMMARY OF THE INVENTION

It is an object of this invention to remove such prior problems by providing a pneumatic-type expanding headpiece, which can be at all times perfectly centered with respect to the reel core, even where the core is subjected to deformation during the operating steps.

It is another object of the invention to provide an expanding headpiece for reels in general, which allows the attachment of the headpiece to the rotary shaft to be carried out without involving of necessity the provision of additional mechanical fasteners, since it is the very means which produces the outward expansion that provide an adequate securing force on the rotary shaft.

A further object of this invention is to provide an expanding headpiece which, being pneumatically operated, can accommodate any play occurring in the course of the various operating steps, to always keep the reel perfectly centered.

A not unimportant object of the invention is to provide an expanding headpiece which has a much lighter weight than conventional ones, to make the headpiece extremely convenient to handle and versatile in use.

These and other objects, such as will be apparent hereinafter, are achieved by an expanding headpiece for reels in general, according to the invention, which comprises first and second flanges, mutually secured coaxially together in spaced apart relationship, at the area included between said flanges there being provided an annular chamber of an elastically deformable material adapted to be expanded pneumatically to make said headpiece rigid with the interior of a reel core or the like, characterized in that it comprises, located between said first and second flanges and at at least one base of said annular chamber, means for centering said headpiece on said reel core, said means being radially expansible by the expansion of said annular chamber in an axial direction.

BRIEF DESCRIPTION OF THE DRAWINGS

Further features and advantages will be apparent from the following description of a preferred, but not limitative, embodiment of this expanding headpiece for reels in general, with reference to the accompanying illustrative drawings, where.

DESCRIPTION OF THE PREFERRED EMBODIMENT

Figure 1:
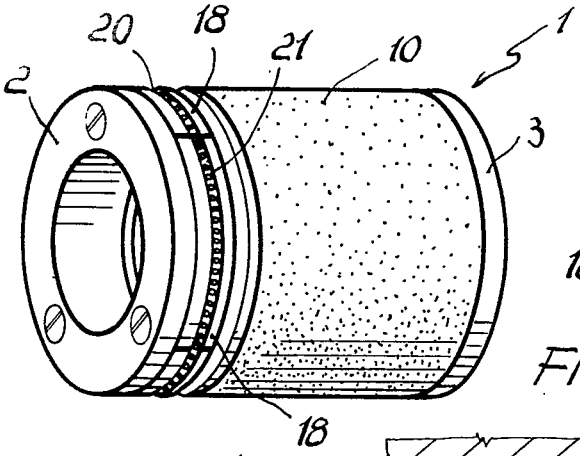
FIG. 1 is a perspective view of the expanding head according to the invention.
Figure 4:
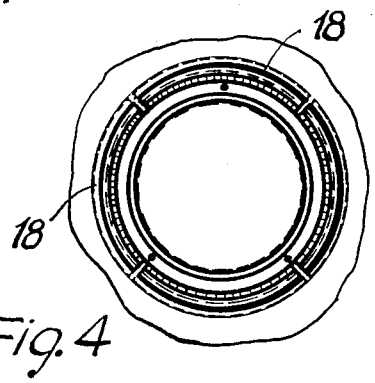
FIG. 4 shows the headpiece as viewed from an axial end to evidence the centering means.

Making reference to the drawing figures, and in particular to FIGS. 1 to 4, the expanding headpiece for reels in general, according to the invention, and designated with the reference numeral 1, includes a first flange 2 and a second flange 3, which are coaxial to each other and mutually spaced apart. The flanges 2 and 3 are secured to each other by means of tie elements 4 arranged circumferentially and also extending in an axial direction.

At the area included between the flanges 2 and 3, there is provided an annular chamber 10 of an elastically deformable material, which can be expanded by pneumatic action such as to make the circumferential headpiece rigid with the interior of the core 11 of a reel or the like.

A first peculiarity of the invention resides in the annular chamber 10 being enabled, in its radial expansion in both directions, to also make the headpiece rigid with the rotation shaft 12 passed through the flange interiors.

This is made possible by that the inside surface of the annular chamber, or at least portions of that surface, are arranged to contact the rotation shaft 12, so that the radial expansion of the chamber results in the headpiece being anchored both relatively to the rotation shaft and the reel 11.

To achieve the desired values of resistance to the torque moment, the annular chamber 10 has a greater axial length than currently used pneumatic chambers, which only provide for anchoring to the inner core of the reel. It will be noted that structurally the annular chamber 10 has in inflated condition on the outside a peripheral lateral surface at its opposite ends annular base formations and internally an inward surface.

Furthermore, to achieve the largest contact surface area between the annular chamber and rotation shaft 12, the connection ties or links 4 are arranged to extend inside channels 5 which are formed longitudinally in the annular chamber 10 and separated from the chamber in sealed relationship therewith, since during the chamber manufacturing process, passages are formed in practice which will constitute the channels 5.

Of course, using the same principle, it will be possible to otherwise embody the invention, with provision in all cases for securing the headpiece to the rotation shaft by pneumatic expansion, such as by providing an apertured cylindrical core joining the flanges 2 and 3 together, and inserts defined on that cylindrical core which would, however, be retracted radially onto the shaft, again by the expanding action of the annular chamber.

At one base of the cited annular chamber 10, a centering means is provided which comprises an annular base member or flange 15 associated with an axial base of the chamber 10, which has a frustoconical annular projection 16, said projection acting as spreader means with its sloping surface on the inclined surfaces 17 of radial sectors 18 acting as radially shiftable engagement members in contact therewith, said radial sectors slidably abutting against a radial surface 2*a* of the flange 2, (similar means such as radially movable pistons guided in the axial direction may be provided) such that, owing to the expansion in the axial direction of the annular chamber 10 which will, of course, expand in any possible direction, the annular flange 15 is shifted axially, thereby owing to the frustoconical projection 16 engaging with the inclined frustoconical surfaces 17 of the sectors 18, expansion in a radial direction of the sectors 18 is achieved which function as the means of centering the headpiece on the reel, since they are unaffected by the applied weight load of the reel during the processing steps in that they are of a mechanical character. It will be understood that the frustoconical projections 16 act as spreader means for the sectors 18 and that for centering purposes at least one pair of diametrically opposite sectors 18 should be provided. Moreover, it will be understood that, in the embodiments shown the flange 2 acts together with the spreader means 15 as a component part of the centering means.

It should be further added that provided on the outer surfaces of the sectors 18—which in the inoperative condition thereof, i.e. with the annular chamber 10 in a collapsed condition, are set flush with the flanges 2 and 3—is a respective circumferential groove 20, wherein is active a closed pattern spring 21 effective to hold the sectors locked radially by drawing them inwardly when not urged outwardly by the frustoconical surface 16 engaging with the inclined frustoconical surface 17.

Moreover, coil springs 22 are provided which act between the annular flange 15 and flange 2 to shift the flange 15 upon removal of the pressure action exerted by the annular chamber 10, thus enabling the annular flange 15 to move in the opposite direction and the sectors 18 to be retracted.

Figure 5:
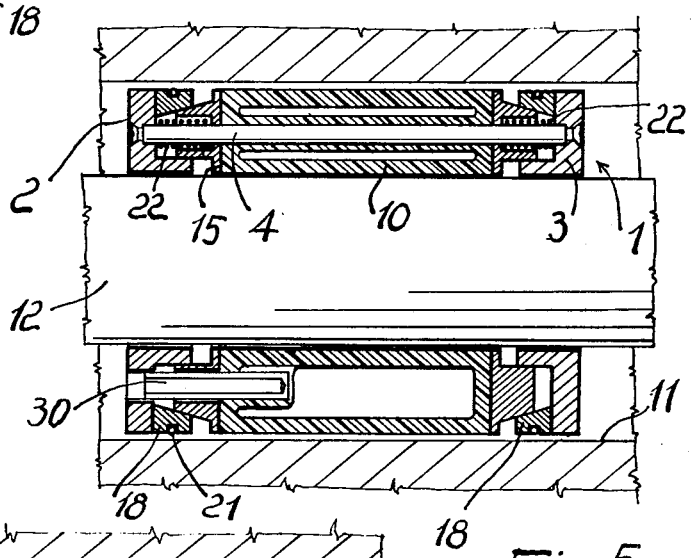
FIG. 5 is an axial sectional view of a headpiece having centering means at either bases of the annular chamber.

With reference to FIG. 5, an embodiment of the invention is shown which is similar in principle to the embodiment described in the foregoing, but with the difference that a centering means is provided at either axial bases of the annular chamber 10.

It should be further added for completion of description that the annular chamber 10 is communicated to the outside by means of a port 30 wherein a conventional valve is provided to admit compressed air for expansion purposes and discharge it when restoration to the initial condition is required.

Figure 6:
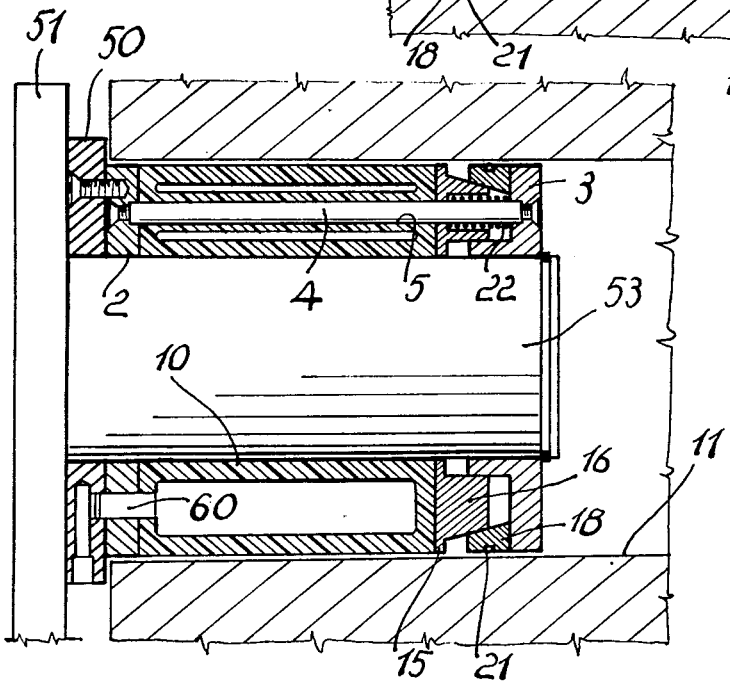
FIG. 6 is an axial sectional view of an expanding headpiece for attachment to the axial ends of a reel core.
Figure 2:
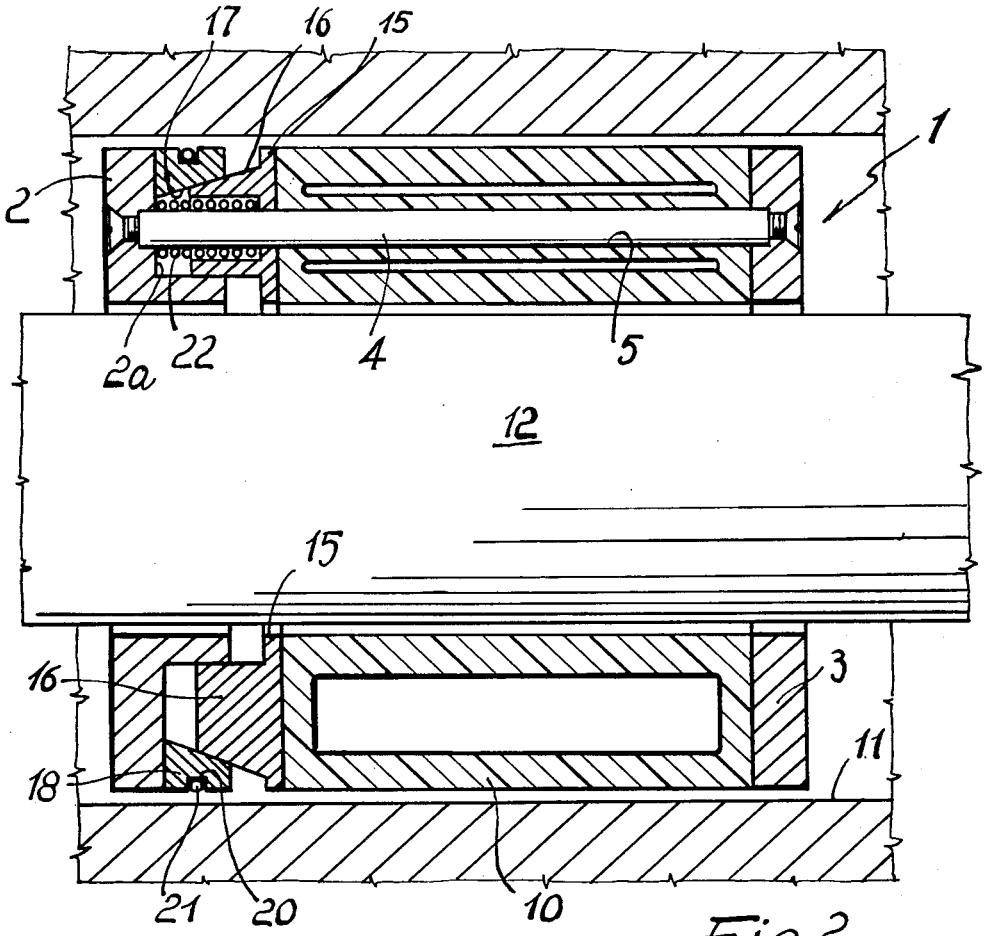
FIG. 2 is an axial sectional view of the headpiece, shown prior to the expansion thereof.
Figure 3:
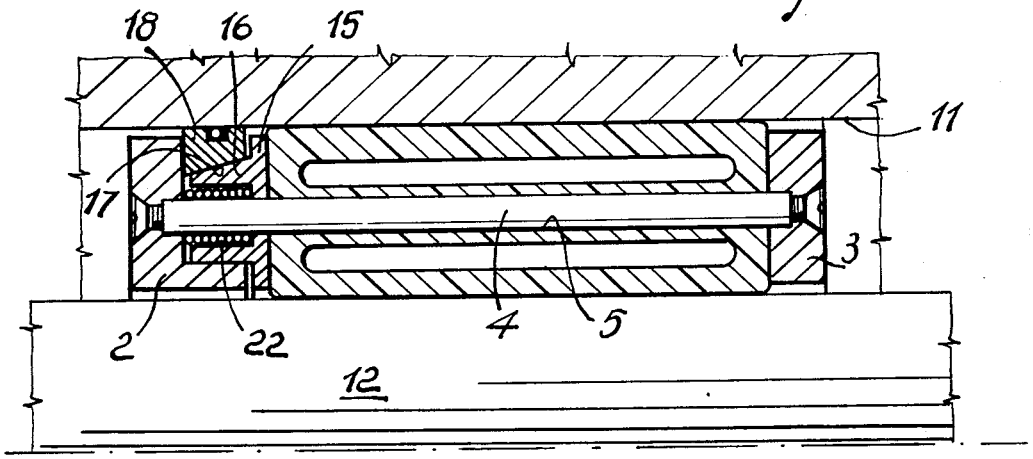
FIG. 3 is a sectional view of the headpiece in its expanded condition.

FIG. 6 illustrates an embodiment of the invention, similar in principle to the previous ones, but intended for use in so-called shaft-less systems. It includes a base flange 50 associated with a shoulder 51 on the system, flange which is rigid with the first flange 2 and provided with a stationary inner core 53 which carries, in practice, the whole headpiece.

Also in this case, the inventive headpiece would comprise the annular chamber 10 which acts on the centering means in a wholly similar way to the foregoing description, although in this specific case the annular chamber 10 would not, of course, serve the function of locking the headpiece onto the rotation shaft, because the shaft is replaced by the core 51, made rigid with the flanges 2 and 3; the ties 4 being attached to the flanges 2 and 3 and passed through the annular chamber 10 to prevent the chamber from turning relatively to the flanges 2 and 3.

To blow air into the base flange 50, an angled conduit 60 is provided which provides access to the inflating valve means of the chamber 10. The use of the expanding headpiece described hereinabove is quite straightforward. In fact, after mounting the headpiece on the rotation shaft 12 and inserting it, along with the shaft, inside the core 11 of a reel, compressed air is pumped into the annular chamber 10, which in expanding both in a radially outward direction and radially inward direction, locks the headpiece both to the reel core and the rotation shaft making them rotatively rigid together.

Moreover, the axial direction expansion of the chamber 10, by acting on the flange 15, automatically activates the centering means, with attendant radial expansion of the sectors 18 which perfectly center the core 11 with respect to the headpiece, thereby there occur no eccentricity phenomena such as are to be found on conventional pneumatically expansible headpieces.

Moreover, since the force exerted by the expansion of the chamber 10 acts constantly on the centering means, said means can automatically accommodate any play which may be developed in the course of the various operating steps.

In the instance of the headpiece having no inner rotation shaft, the operation is similar in principle in that the introduction of compressed air, by causing the chamber 10 to expand radially outwards, results in rotatively locking together the headpiece and reel core, and the expansion of the annular chamber 10 in the axial direction results in the sectors 18 moving radially out and functioning as centering means capable of accommodating any play developed during the processing operation.

It will be appreciated from the foregoing that the invention achieves its objects, and in particular that the expanding headpiece, according to this invention, does away with the necessity for securing the headpiece to the rotation shaft by means of either clamps or jaws, as is instead the case with prior art headpieces, since it is the expansible annular chamber itself that provides locking onto the inner shaft, where required; moreover, the annular chamber directly activates the centering means, thus eliminating any eccentricity phenomena, while the centering means can accommodate any developed play and maintain perfectly centered conditions throughout the operating steps.

The invention as described in the foregoing is susceptible to many modifications and variations without departing from the scope of the inventive concept.

Furthermore, all of the details may be replaced with other, technically equivalent, elements.

In practicing the invention, the materials used, and the dimensions and contingent shapes, may be any ones meeting individual requirements.

I claim:

1. An expanding headpiece for connection with a circumferential inside of a reel core in general, comprising first and second flange members in spaced apart relationship and defining an axis and a space therebetween, means for coaxially securing together said flanges, an inflatable annular chamber of elastically deformable material arranged in said space included between said flanges, said inflatable chamber having a peripheral lateral surface, base formations at opposite ends thereof and a circumferential inward surface, centering means arranged near at least one of said flanges, said centering means having at least one cooperating member having an annular surface in coaxial relationship with said axis, at least one pair of diametrically opposite engagement members slidable radially with respect to said one cooperating member of the centering means and having an engagement surface facing in use said core of the reel and spreader means for said engagement members, wherein in inflated condition said inflatable annular chamber in use is radially expanded and is pressed with said peripheral lateral surface thereof against the inside of said core thereby to render said core rigid with said headpiece, said annular chamber in inflated condition being also axially expanded to press with at least one base formation thereof said spreader means thereby to radially shift said engagement members to cause in use said engagement members to be pressed against said inside of the core and thereby center the coaxial relationship between said headpiece and said core.

2. A headpiece according to claim 1, in cooperation with a rotation shaft coaxial therewith, wherein in inflated condition of said inflatable annular chamber, at least part of said circumferential inward surface thereof is expanded towards said axis thereby to press in use said inward surface part against said shaft to render said headpiece rotatively rigid with said shaft and wherein said annular surface of said cooperation member faces said shaft.

3. A headpiece according to claim 1, wherein said at least one cooperating member of said centering means is defined by one of said flanges.

4. A headpiece according to claim 1, wherein said at least one cooperating member of said centering means is defined by one of said flanges and wherein said cooperating member comprises radial sliding surfaces for slidably guiding said engagement members in radial direction with respect to said axis, said engagement members having a sloping surface inclined with respect to said axis and cooperating with said spreader means thereby to spread radially said engagement members to abut in use against said circumferential inside of said core and center said core with respect to said flange members.

5. A headpiece according to claim 1, wherein said spreader means comprise said base formations having a frustoconical shape facing said flange members and in slidable engagement with said engagement members.

6. A headpiece according to claim 1, wherein said means for coaxially securing together said first and said second flanges comprise tie rod members and wherein said annular chamber comprises throughgoing channels in sealed relationship with the interior thereof for allowing passage therethrough of said tie rod members.

7. A headpiece according to claim 1, wherein said engagement means have on said engagement surface thereof a circumferential groove and circumferential spring means within said groove for urging said engagement members radially towards said axis and yieldably opposing the radial expansion displacement.

8. A headpiece according to claim 5, wherein between said base formations and said flange member coil springs are arranged urging said base formations and said flange members away from each other and yieldably opposing said base formations to be axially displaced towards said flange members.

9. A headpiece according to claim 1, for application in shaftless systems, wherein said opposite base formations are in the form of opposite base members attached to the opposite ends of said inflatable annular chamber, one of said base members being rigid with one of said flange members and the other of said base members forming said spreader means.

* * * * *